United States Patent [19]

Duchenois et al.

[11] Patent Number: 4,672,193

[45] Date of Patent: Jun. 9, 1987

[54] MICRO-CHANNEL PLATE SUPPORT AND LEAD STRUCTURE

[75] Inventors: Valére D. L. Duchenois, Paris; Bernard L. P. Jean, Chevilly-Larue, both of France

[73] Assignee: U.S. Philips Corporation, New York, N.Y.

[21] Appl. No.: 851,891

[22] Filed: Nov. 25, 1985

Related U.S. Application Data

[63] Continuation of Ser. No. 535,125, Sep. 23, 1983, abandoned.

[30] Foreign Application Priority Data

Oct. 1, 1982 [FR] France ..... 82 16551

[51] Int. Cl.[4] ..... H01J 40/14

[52] U.S. Cl. ..... 250/207; 250/213 VT; 313/105 CM

[58] Field of Search ..... 250/207, 213 R, 213 VT, 250/239; 330/42; 313/532–536, 103 R, 103 CM, 104, 105 R, 105 CM

[56] References Cited

U.S. PATENT DOCUMENTS 4,100,406 7/1978 Loty ..... 250/213 VT

*Primary Examiner*—David C. Nelms

[57] ABSTRACT

An electron multiplier includes a micro-channel plate (12) having secondary electron emission. The channel plate is fitted in an annular metal frame (16, 17) which is in direct electrical contact with one (13) of the metallizations (13, 14) on the faces of the channel plate. The frame constitutes the means to apply an electric potential to one of the faces of the channel plate. The means to apply an electric potential to the other face of the channel plate are constituted by metallic contact studs (25) fixed in an insulated manner on the metallic frame and connected to the metallization (14) of the other face by means of conductor wires (30). The multiplier is incorporated in a detector device, the frame being soldered to the body (45) of the device by means of rods (48) traversing the body and soldered thereto.

7 Claims, 2 Drawing Figures

MICRO-CHANNEL PLATE SUPPORT AND LEAD STRUCTURE

This is a continuation of application Ser. No. 535,125, filed Sept. 23, 1983 now abandoned.

BACKGROUND OF THE INVENTION

The present invention relates to an electron multiplier having a micro-channel plate and to the application of the multiplier in radiation or particle detector devices.

When a micro-channel plate is introduced in a radiation or particle detector device, a certain number of difficulties are encountered. Said difficulties appear when, for example, an image intensifier tube of the proximity focus type is considered. Such a tube comprises generally an evacuated envelope which is closed by means of windows which are transparent to the light. Parallel to said windows there are a photocathode, a micro-channel plate and a fluorescent screen. Adequate electric potentials are applied to the various electrodes of the image intensifier. A problem to be solved relates to the uniformity of the interelectrode distance such that the spatial resolution of the amplified image is uniform. This problem is the more difficult to solve when the interelectrode distances are small, typically of a few tenths of a mm between the input face of the channel plate and the photocathode and 1.5 mm between the output face of the channel plate and the screen. If one succeeds easily to solve this type of difficulty when the diameter of the tube, hence that of the channel plate is medium, for example 2 to 3 cm, it is much more difficult to solve when the diameter is larger, for example of the order of 4 to 6 cm. It is difficult to avoid deformations of the micro-channel plate which occur as a result of thermal treatments to which it is subjected during the manufacturing process of the tube. Said deformations do not permit of maintaining a uniformity of the distances between the opposite faces of the channel plate and electrodes and hence also of the spatial resolution over the whole extent of the electrical field in the tube.

Another problem to be solved relates to the supply of electrical potentials to the metallized input face and output face of the channel plate. In prior art structures, the electrical potentials are generally applied to each face of the channel plate by means of metallic spring members resting on the periphery of the plate. During assembly, the use of such springs presents the disadvantage that, as a result of the pressure which they exert on the plate at the points of contact, grooves are often formed in the usually glass channel plate or even cracking or breaking of the plate may occur. Moreover, this type of contact is unsuitable in case the device in which the plate has been integrated would have to operate in the presence of severe vibrations. As a result of said vibrations there would be sliding of the plate on its contacts with abrasions of the metallizations and of the glass with the same consequences as those described previously.

SUMMARY OF THE INVENTION

One of the objects of the invention is to provide a solution to the problems described above in the use and the operation of a micro-channel plate.

A further object of the invention is to extend the use of the micro-channel plates to those of large diameters, for example of the order of 4 to 6 cm, while giving them the flatness necessary to obtain a great uniformity of spatial resolution and, moreover, to ensure that they can operate in the presence of severe vibrations of the devices in which they are incorporated.

After having procured a micro-channel plate, the user generally is confronted with the difficulties of its operation and its assembly in the device in which it is to be incorporated. Another object of the invention is to facilitate the use of the micro-channel plate by delivering the channel-plate to the user together with the means facilitating, during its incorporation in said device, its fixation and the application of the electrical potentials to its faces. Said means being such that they permit the use of the plate in the presence of vibrations.

According to the invention, an electron multiplier of the type comprising a micro-channel plate having secondary electron emission and means for applying electrical potentials to each of the metallizations of the faces of the said plate is characterized in said plate is fitted in a metallic frame surrounding said plate, the metallic frame being in contact with one of the metallizations of the faces of the plate and constituting the means for applying an electrical potential to said face, the means for applying an electrical potential to the other face being constituted by metallic contact studs fixed on the metallic frame in a manner so as to be electrically insulated therefrom and being connected to the metallization of said other face by means of metallic leads.

The invention also relates to a radiation or particle detector device incorporating said electron multiplier. According to the invention, such a device is characterized in that it comprises an insulating cylindrical member traversed laterally by metal rods for the supply of electrical potentials to the faces of the channel plate, certain of said rods being rigidly connected to said metallic frame, others of said rods. each being connected to a respective conductor which in its turn is connected to one of the contact studs.

BRIEF DESCRIPTION OF THE DRAWING

An embodiment of the invention will now be described in greater detail, by way of example, with reference to the accompanying drawings, in which:

In FIG. 1, the part of the multiplier is encircled by the irregular line 11.

In FIG. 2, said multiplier is limited by the circle 33.

DESCRIPTION OF THE PREFERRED EMBODIMENT

Figure 1:
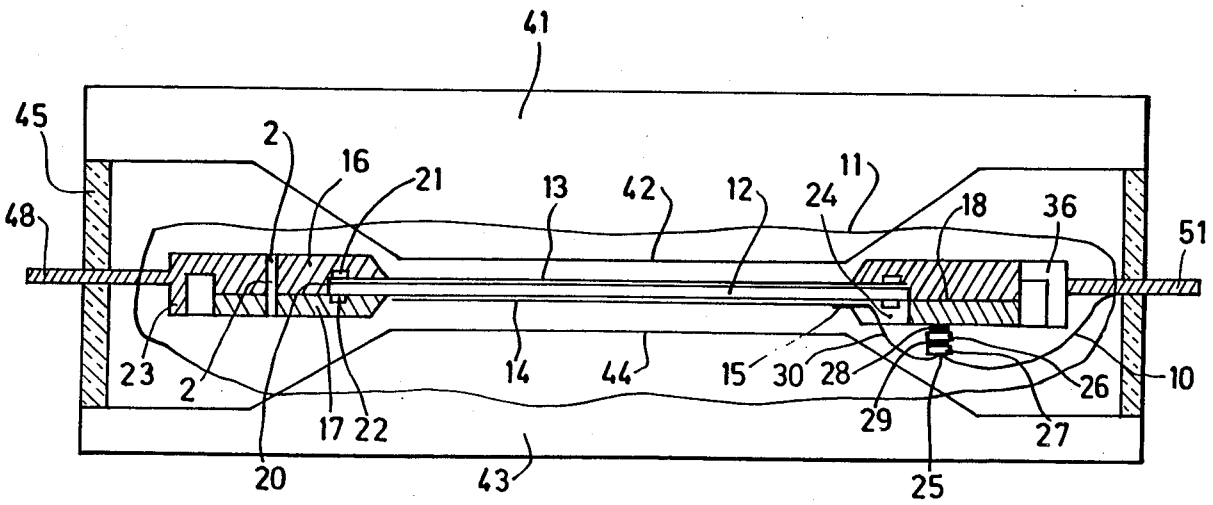
FIG. 1 is a transverse sectional view according to the diameter AB of FIG. 2 of an image intensifier tube incorporating an electron multiplier according to the invention.
Figure 2:
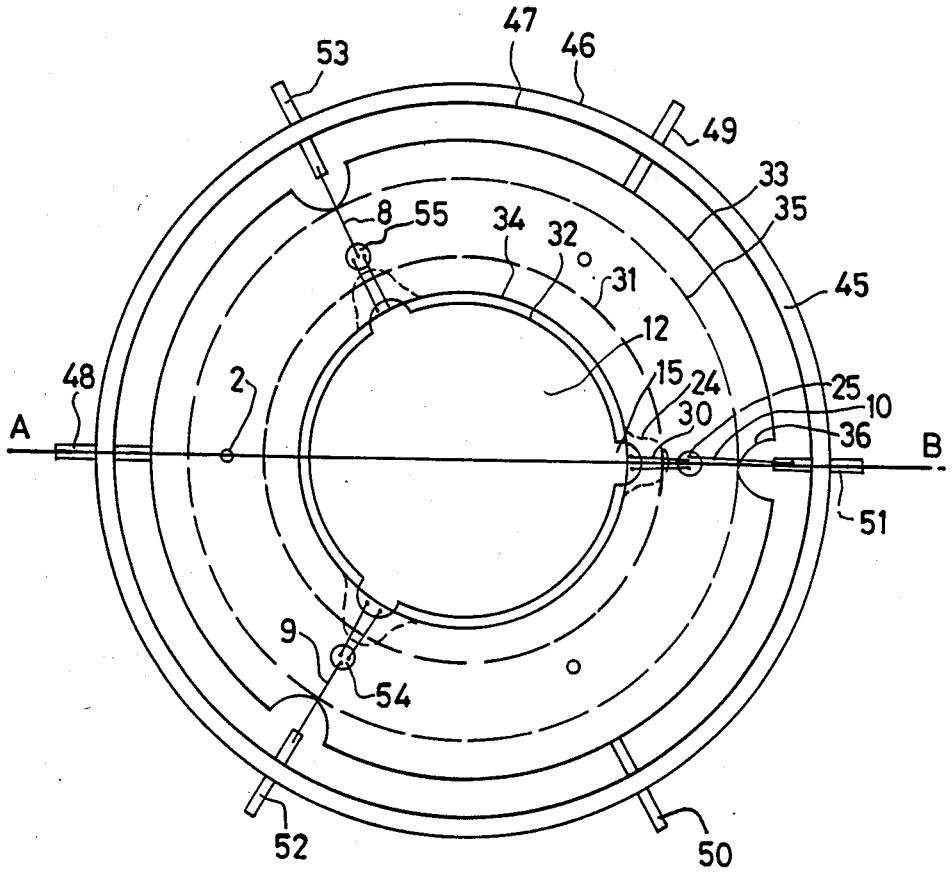
FIG. 2 is a bottom view of the output side of the channel plate of the image intensifier tube shown in FIG. 1.

The electron multiplier of the image intensifier tube shown in FIG. 1 and FIG. 2 includes a micro-channel plate 12 with secondary electron emission. On the input side, the channel plate is provided with a metallization 13 and, on the output side, with a metallization 14. Said plate is, for example, circular. In FIG. 2, the circle 31 represents the outer contour of the plate and, at the same time, although this is not necessary for the invention, the outer contour of the metallization 13 of the input face of the plate. The circle 32 represents the outer limit of the metallization 14 on the output face of the plate. Metallic members constituting a metallic frame are the circular members 16 and 17. In FIG. 2, the circles which limit the member 16 are the circles 33 and 34. The circles which limit the member 17 are the circles 34 and 35. Said members are applied one on the other according to their plane part 18. The members 16 and 17 are held in contact by means of a certain number of screws 2. The member 16 presents a rectangular cavity 20 in which the plate 12 is placed. The members 16 and 17 are provided with grooves 21 and 22 in which a soldered joint is present, for example, an indium joint. Prior to soldering, the surfaces to be joined are covered with the usual underlying metal layers (Ni Cr, Ni, Au) for adherence and wetting. The diameter of the circle 31 of the metallization 13 of the input face of the plate is larger than that of the circle 34.

The member 16 is directly in contact with the metallization 13. Said member 16 presents a circular L-shaped skirt 23 on which a rigid contact may be provided as will be explained hereinafter. The contact on the metallization 14 of the output face is effected by means of contact pads 15 which are placed in a recessed part 24 (non-shaded part in FIG. 1) provided in the member 17. The pad 15 is connected to a contact stud 25 fixed on the member 17 and electrically insulated therefrom. The stud 25 is advantageously constituted by an insulating block of glass 26 on which is mounted a block of metal 27. The block 26 is bonded by thermocompression to the member 17 after the interposition of a metal strip 28, for example, of aluminium. The metal block 27 is bonded by thermocompression to the block 26 after the interposition of an aluminium strip 29. The electric connection between the pad 15 and the stud 25 is advantageously effected by means of one or several thin metal wires 30, for example gold wires having a diameter of about 30 μm, soldered by thermocompression to the pad 15 and to the metallic block 27. The member 16 has a recess 36 (nonshaped part in FIG. 1) which permits the prolonging of the electric connection from the metallization 14 of the output face towards the exterior of the multiplier without the risk of shortcircuit with the input metallization 13. The prolongation is effected by means of a lead 10. The material of the members 16 and 17 is chosen among those of which the coefficient of linear expansion is near that of the glass of the channel plate such that the plate does not deform during thermal treatments. The material may be an alloy of ferronickel of a nickel and iron percentage by weight of 52 and 48, respectively. It will be obvious that other materials may be used. In order to dissipate any mechanical stress in the metal, same is subjected before its use to a heating of several hours (800° C.) in a reducing atmosphere succeeded by a very slow cooling.

FIGS. 1 and 2 show the integration of the multiplier in the interior of the photo-electric tube of the image intensifier type. The input window is referred to by reference numeral 41. The photocathode is deposited on the face 42. The output window, for example in the form of optical fibers, is referred to by 43. The screen is deposited on the face 44 of said output window. A body 45 of the tube has the form of a truncated cylinder, the material constituting said body being insulating, for example, of glass or ceramic. In FIG. 2, said body of the tube is denoted by circles 46 and 47. The multiplier described hereinbefore and incorporated in said tube is rigidly fixed in said tube. Said rigid fixing is effected by means of a certain number of metallic rods 48 soldered to the circular L-shaped skirt 23. In FIG. 2, there are three rods 48, 49, 50. Said rods traverse the body 45 of the tube and are soldered to it. They permit applying from the exterior an electric potential to the input face of the channel plate. Other rods 51, 52, 53, also soldered to the body of the tube, are present opposite to rods 48, 49, 50, respectively. Said other rods are connected to the contact studs 25, 54, 55, respectively, through the intermediary of metallic leads 10, 9, 8, respectively, and permit supplying the electric potential to the output face of the channel plate.

It will be obvious that said multiplier may by integrated in any other radiation or particle detector device, its fixation in said device being effected in the manner as described in the above paragraph.

What is claimed is:

1. An electron multiplier comprising a micro-channel plate having a metallized first face and a metallized second face generally parallel to the first face, and means for applying electric potentials to the first and the second faces of the plate, characterized in that the applying means includes a metallic frame surrounding the plate, the metallic frame electrically contacting the metallization of the first face, and further includes metal contact studs fixed on and electrically insulated from the metallic frame, the contact studs being connected electrically to the metallization of the second face by means of metallic leads.

2. An electron multiplier as claimed in claim 1, characterized in that the metallic frame includes two annular members having inner edges enclosing the micro-channel plate, the metallization on the first face having a diameter larger than the diameter of a circle limiting the inner edges of the two annular members, the metallization on the second face having a diameter smaller than the diameter of the circle and being provided with contact pads disposed partly in recesses formed in one of the two annular members, the metal contact studs being fixed on and electrically insulated from the one annular member, the metallic leads connecting electrically the contact pads with the contact studs.

3. An electron multiplier as claimed in claim 1, wherein the plate includes glass, and wherein the metallic frame consists essentially of a material having a coefficient of linear expansion which is near that of the glass.

4. An electron multiplier as claimed in claim 3, wherein the material is a ferronickel.

5. An electron multiplier as claimed in claim 1, wherein the first face is an input face and the second face is an output face of the electron multiplier.

6. A radiation detector comprising an electron multiplier as claimed in claim 1, characterized in that the detector further comprises an insulating cylindrical member traversed laterally by metal rods for the supply of the electrical potentials to the faces of the channel plate, certain of said robs being rigidly connected to the metallic frame, others of said rods each being connected to a respective contact stud which is connected to a respective contact pad.

7. A detector as claimed in claim 6, characterized in that the detector is an image intensifier tube comprising an input window supporting a photocathode, an output window supporting a screen, the multiplier being provided between the photocathode and the screen.

* * * * *